US007074324B2

(12) United States Patent
Feimer et al.

(10) Patent No.: US 7,074,324 B2
(45) Date of Patent: Jul. 11, 2006

(54) PROCESS TO REMOVE SULFUR CONTAMINANTS FROM HYDROCARBON STREAMS

(75) Inventors: Joseph L. Feimer, Bright's Grove (CA); Bal K. Kaul, Randolph, NJ (US); Lawrence J. Lawlor, Camlachie (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 226 days.

(21) Appl. No.: 10/423,076

(22) Filed: Apr. 25, 2003

(65) Prior Publication Data

US 2003/0226786 A1 Dec. 11, 2003

Related U.S. Application Data

(60) Provisional application No. 60/386,489, filed on Jun. 5, 2002.

(51) Int. Cl.
*C10G 25/05* (2006.01)
*C10G 25/12* (2006.01)

(52) U.S. Cl. ..... 208/213; 208/216 R; 208/217; 208/221; 208/222; 208/243; 208/244; 585/820; 585/826

(58) Field of Classification Search ..... 208/213, 208/216 R, 217, 221, 222, 243, 244; 585/820, 585/826

See application file for complete search history.

(56) References Cited

U.S. PATENT DOCUMENTS

| | | | | |
|---|---|---|---|---|
| 4,397,739 A | | 8/1983 | Jacquin et al. | 208/210 |
| 4,464,252 A | | 8/1984 | Eberly, Jr. et al. | 208/243 |
| 4,619,759 A | | 10/1986 | Myers et al. | 208/210 |
| 5,157,201 A | | 10/1992 | Norris | 585/820 |
| 5,271,835 A | | 12/1993 | Gorawara et al. | 208/228 |
| 5,454,933 A | * | 10/1995 | Savage et al. | 208/212 |
| 5,730,860 A | * | 3/1998 | Irvine | 208/213 |
| 5,807,475 A | | 9/1998 | Kulprathipanja et al. | 208/208 R |
| 5,925,239 A | * | 7/1999 | Klein et al. | 208/213 |
| 5,935,420 A | * | 8/1999 | Baird et al. | 208/213 |
| 5,935,422 A | | 8/1999 | Zinnen | 208/310 Z |
| 5,985,136 A | | 11/1999 | Brignac et al. | 208/216 R |
| 6,013,598 A | | 1/2000 | Lapinski et al. | 502/305 |
| 6,126,814 A | | 10/2000 | Lapinski et al. | 208/217 |
| 6,231,753 B1 | | 5/2001 | McKnight et al. | 208/217 |
| 6,231,754 B1 | | 5/2001 | Brignac et al. | 208/217 |
| 6,254,766 B1 | | 7/2001 | Sughrue et al. | 208/244 |
| 6,579,444 B1 | * | 6/2003 | Feimer et al. | 208/243 |

FOREIGN PATENT DOCUMENTS

| | | |
|---|---|---|
| WO | WO/02/08361 | 1/2002 |
| WO | WO/02/053684 | 7/2002 |

OTHER PUBLICATIONS

Gandhi, H.S., et al., "Effects of Sulphur on Noble Metal Automotive Catalysts," Applied Catalysis, V77N.2, 1998.

Gonzales, et al., "Can you make low-sulphur fuel and remain competitive," Hart's Fuel Tech and Management, Nov./Dec. 1996.

Salem, A.B., et al., "Removal of Sulphur Compounds from Naphtha Solutions using Solid Adsorbents," Chemical Engineering and Technology, Jun. 20, 1997.

* cited by examiner

*Primary Examiner*—Tam M. Nguyen
(74) *Attorney, Agent, or Firm*—Henry E. Naylor

(57) ABSTRACT

A process for removing sulfur compounds from hydrocarbon streams by contacting the hydrocarbon stream, especially a gasoline stream, with an adsorbent material. The adsorbent material is regenerated with hydrogen or a hydrogen/$H_2S$ mixture.

15 Claims, 1 Drawing Sheet

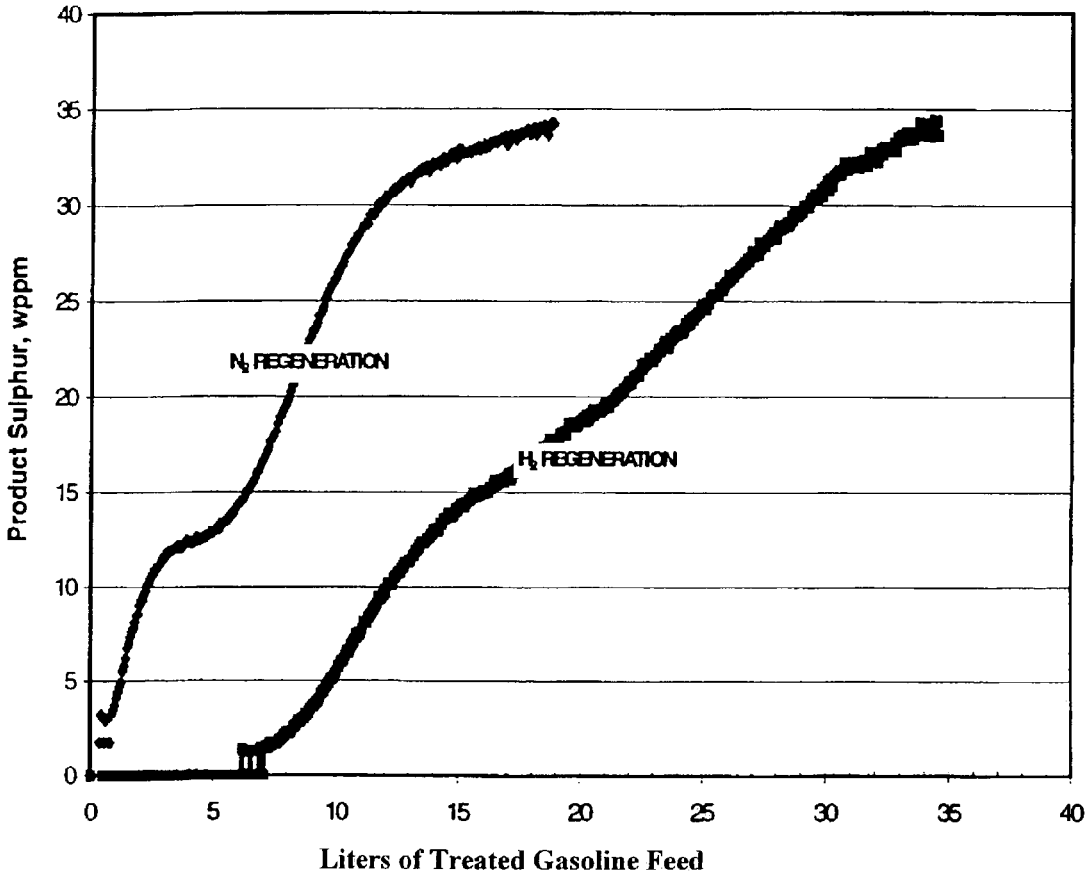
Product Sulphur, wppm
40
35
30
25
20
15
10
5
0
0
5
10
15
20
25
30
35
40
Liters of Treated Gasoline Feed
N2 REGENERATION
H2 REGENERATION

PROCESS TO REMOVE SULFUR CONTAMINANTS FROM HYDROCARBON STREAMS

CROSS REFERENCE TO RELATED APPLICATION

This application claims benefit of U.S. Provisional Patent Application No. 60/386,489 filed Jun. 5, 2002.

FIELD OF THE INVENTION

The present invention relates to a process for removing sulfur compounds from hydrocarbon streams by contacting the hydrocarbon stream, especially a gasoline stream, with an adsorbent material. The adsorbent material is regenerated with hydrogen or a hydrogen/$H_2S$ mixture.

BACKGROUND OF THE INVENTION

The presence of sulfur moieties in petroleum feedstreams is highly undesirable since they can cause corrosion and environmental problems associated with end products, such as transportation fuels. Sulfur moieties can also affect the performance of engines using such fuels. Refined hydrocarbon streams are generally not transported in a pipeline previously used for the transportation of sour hydrocarbon streams, such as petroleum crudes, because the streams, such as gasoline and diesel fuels, can pick up contaminants from the pipeline, such as elemental sulfur. For example, about 10 to 80 mg/L of elemental sulfur is picked-up by gasoline and about 1 to 20 mg/L elemental sulfur is typically picked-up by diesel fuel when pipelined. Sulfur has a particularly corrosive effect on equipment, such as brass valves, gauges, silver bearing cages in two-cycle engines, and in-tank fuel pump copper commutators.

While maximum sulfur levels of 1000 wppm are found in some motor gasolines, government regulations will lead to sulfur levels of less than 30 wppm after 2003. Although significant changes in engine design have reduced total emissions, further decreases in level of sulfur emissions would be desirable.

Refiners have various options for producing low-sulfur gasoline. For example, they can refine relatively low sulfur crudes, or they can hydrotreat refinery streams to remove contaminants or use processes that include adsorption and absorption to remove contaminants. The world supply of low sulfur (sweet crude) is rapidly diminishing and, therefore, processing low sulfur crudes is not considered a long-term option.

Cracked naphthas, such as those derived from a fluidized catalytic cracking unit (FCCU), cokers and other high temperature cracking units have a high sulfur content compared to other gasoline blending components of the gasoline pool. A large portion of this sulfur is concentrated in the back end of the naphtha, i.e., heavy naphthas such as heavy cat naphtha. Therefore, reducing sulfur in gasoline could involve treating the feed and/or the products from a heavy naphtha process unit, such as a FCCU.

Gonzales et al. ("Can You Make Low-Sulfur Fuel and Remain Competitive," Hart's Fuel Technology and Management, November/December 1996) indicates that cat feed desulfurization can reduce sulfur levels in cracked naphtha to about 500 wppm, or less. However, the cost of this option is generally balanced against the advantage of the higher gasoline conversions as a result of cat feed desulfurization. In another option, sulfur levels lower than about 200 wppm are achievable via non-selective hydrodesulfurizaton of light cracked naphtha. However, this can be incrementally more expensive than cat feed desulfurization because of the high hydrogen consumption and loss of octane due to the hydrogenation of olefins. Hydrotreated cracked-naphtha can be isomerized to recover some of the lost octane, but at additional cost. It is clear from the above information that there will be a significant cost associated with reducing the sulfur levels in gasoline, especially down to very low levels, such as 30 wppm.

Adsorption is often a cost-effective process to remove relatively low levels of contaminants. Salem, A. B. et al., "Removal of Sulfur Compounds from Naphtha Solutions Using Solid Adsorbents," Chemical Engineering and Technology, Jun. 20, 1997, report a 65% reduction in the sulfur level (500 to 175 wppm) for a 50/50 mixture of virgin and cracked naphthas using activated carbon at 80° C. and a 30% reduction using Zeolite 13X at 80° C. Also, U.S. Pat. No. 5,807,475 teaches that Ni or Mo exchanged Zeolite X and Y can be used to remove sulfur compounds from hydrocarbon streams. Typical adsorption processes have an adsorption cycle whereby the contaminant is adsorbed from the stream followed by a desorption cycle whereby the adsorbent is regenerated by removing at least a portion, preferably substantially all, of the contaminants therefrom.

As with hydrotreating, adsorption will improve the stability of the gasoline product by removing unstable heteroatoms, such as nitrogen and sulfur contaminants.

Typically, the desorbed material produced during a conventional regeneration cycle contains a relatively high level of contaminants and is thus generally difficult and expensive to dispose of. Therefore, a regeneration cycle that produces a desorbed stream having relatively low levels of contaminants is highly desirable.

SUMMARY OF THE INVENTION

In accordance with the present invention, there is provided a process for removing sulfur moieties from a sulfur moiety-containing hydrocarbon stream, which process comprises:

contacting the sulfur moiety-containing hydrocarbon stream with an adsorbent material comprised of at least one Group VIII metal and at least one Group VI metal on a suitable refractory support material until the adsorbent material becomes substantially saturated;

regenerating the substantially saturated adsorbent material at hydrodesulfurization conditions in the presence of a flow of hydrogen-containing gas at effective pressures and temperatures to result in the desulfurization of at least a portion the adsorbed sulfur moieties from the adsorbent material.

In a preferred embodiment, the sulfur moiety-containing stream is selected from naphtha boiling range steams and distillate boiling range streams. Removing sulfur contaminants from hydrocarbon steams using an adsorbent combined with the regeneration technique described in the present invention wherein the adsorbent is treated with a hydrogen-containing gas, has significant advantages over conventional hydrotreating. These advantages include, but are not limited to, high product yields, no significant loss of octane, no significant saturation of olefins, relatively low hydrogen consumption, and relatively low capital and operating costs owing to the fact that only relatively low pressures and temperatures are required.

BRIEF DESCRIPTION OF THE FIGURE

The sole FIGURE shows sulfur breakthrough curves for nitrogen and hydrogen regeneration corresponding to Examples 1 and 2 hereof.

DETAILED DESCRIPTION OF THE INVENTION

The present invention comprises a method for reducing the amount of sulfur compounds in hydrocarbon feedstreams, preferably petroleum feedstreams boiling from about the naphtha (gasoline) range, and including, the distillate boiling range. The preferred streams to be treated in accordance with the present invention are naphtha boiling range streams that can also be referred to as gasoline boiling range streams. Naphtha boiling range streams can comprise any one or more refinery streams boiling in the range from about 10° C. to about 230° C., at atmospheric pressure. The naphtha boiling range stream usually contains cracked naphtha, such as fluid catalytic cracking unit naphtha (FCC catalytic naphtha, or cat cracked naphtha), coker naphtha, hydrocracker naphtha, resid hydrotreater naphtha, debutanized natural gasoline (DNG), and gasoline blending components from other sources from which a naphtha boiling range stream can be produced. FCC cat naphtha and coker naphtha are generally more olefinic naphthas since they are products of catalytic and/or thermal cracking reactions. They are the more preferred streams to be treated in accordance with the present invention. The sulfur content of a cat cracked naphtha stream will generally range from about 500 to about 7000 wppm, more typically from about 700 to about 5000 wppm, based on the total weight of the feedstream.

Non-limiting examples of hydrocarbon feedstreams boiling in the distillate range include diesel fuels, jet fuels, heating oils, and lubes. Such streams typically have a boiling range from about 150° C. to about 600° C., preferably from about 175° C. to about 400° C. It is also preferred that such streams first be hydrotreated to reduce their sulfur content, preferably to less than about 1000 wppm, more preferably to less than about 500 wppm, most preferably to less than about 200 wppm, particularly to less than about 100 wppm sulfur, and ideally to less than about 50 wppm.

For naphtha boiling range feedstreams, it is desirable to upgrade these types of feedstreams by removing as much of the sulfur as possible, while maintaining as much octane as possible. This is accomplished by the practice of the present invention primarily because hydrogen is substantially absent during the adsorption cycle, thus minimizing olefin saturation.

As previously mentioned, sulfur moieties of the feedstream to be treated, need to be removed because of their corrosive nature and because of ever stricter environmental regulations governing the final fuel product. Non-limiting examples of sulfur moieties contained in such feedstreams include elemental sulfur, as well as organically bound sulfur compounds such as aliphatic, naphthenic, and aromatic mercaptans, sulfides, di- and polysulfides, thiophenes and their higher homologs and analogs.

Adsorbents suitable for use herein are any suitable hydrotreating catalyst. Suitable hydrotreating catalysts for use in the present invention are any hydrotreating catalyst containing at least one metal from Group VIII of the Periodic Table of the Elements. Preferred catalysts are those that are comprised of at least one Group VIII metal, preferably selected from Fe, Co and Ni, alone or in combination with a component of at least one metal selected from the Group VI metals, Group IA metals, Group IIA metals, and Group IB metals and mixtures thereof More preferably the Group VIII metal is Co and/or Ni, most preferably Co. It is also preferred that at least one Group VI metal, preferably Mo and W, more preferably Mo, be present. It is also preferred that the catalyst be a supported catalyst, more preferably when the support material is an alumina. Other suitable hydrotreating catalysts include zeolitic catalysts, as well as noble metal catalysts where the noble metal is selected from Pd and Pt. It is within the scope of the present invention that more than one type of hydrotreating catalyst be used in the same adsorption zone. The Group VIII metal is typically present in an amount ranging from about 2 to 20 wt. %, preferably from about 4 to 12 wt. %. The Group VI metal will typically be present in an amount ranging from about 5 to 50 wt. %, preferably from about 10 to 40 wt. %, and more preferably from about 20 to 30 wt. %. All metal weight percents are on support. By "on support" we mean that the percents are based on the weight of the support. For example, if the support were to weigh 100 g. then 20 wt. % Group VIII metal would mean that 20 g. of Group VIII metal was on the support. It will be understood that the term "hydrotreating catalyst" preferably means a catalyst that is primarily used for hydrodesulfurization.

The present invention is practiced by introducing, at suitable conditions including in the substantial absence of added hydrogen, the feedstream containing the sulfur moieties into an adsorption zone containing a bed of adsorbent material, which adsorbent material preferably contains at least one Group VIII metal and at least one Group VI metal. After the bed of adsorbent material has become saturated with sulfur moieties, it is regenerated using a hydrogen-containing gas at an effective flow rate and at an effective pressure and temperature. It is preferred that the hydrogen-containing gas be substantially pure hydrogen or a mixture of hydrogen and hydrogen sulfide ($H_2S$). If a mixture of hydrogen and hydrogen sulfide it is preferred that greater than 50 vol. %, more preferably greater than 75 vol. %, and most preferably greater than 90 vol. % be hydrogen. During the regeneration cycle, the hydrogen-containing gas can first be heated before passing through the sulfur-saturated bed. Hydrogen or hydrogen/$H_2S$ can flow either co-current or counter-current with respect to the flow of feedstream to be treated, but under typical operating conditions, the hydrogen or hydrogen/$H_2S$ will flow co-current with the feedstream. The pressures and temperatures of the regeneration cycle are maintained at hydrodesulfurization conditions such that effective pressures are from about 0 to about 2000 psig, preferably from about 60 to about 1000 psig, and more preferably form about 60 to about 500 psig. Effective temperatures are from about 100° C. to about 600° C., preferably from about 200° C. to about 500° C., and more preferably from about 260° C. to about 400° C. Effective hydrogen or hydrogen/$H_2S$ gas flows are preferably greater than about 0.01 ft/min and more preferably greater than about 0.1 ft/min and most preferably greater than about 1 ft/min.

The desulfurized product stream exiting the adsorbent bed can be condensed via a suitable cooling means while the lighter hydrogen or hydrogen/$H_2S$ gas mixture can be either recycled back to the adsorbent bed or can be made to flow through on a once-through basis. As a result, there is no significant loss of octane and there is relatively low hydrogen consumption, i.e. 0.04 scf/bbl of feed.

The following examples are illustrative and are not meant to be limiting in any way.

EXAMPLE 1 (COMPARATIVE)

A stainless steel column, 1.1" ID containing two feet, 370 cc of 1/20" extrudates of an adsorbent comprised of Co and Mo on an alumina support. The concentration of Co, based on the oxide CoO was 5 wt. %, the concentration of Mo, based on $MoO_3$ was 20.4 wt. % with the balance being alumina. The surface area of the adsorbent was about 240 $m^2/g$.

The adsorbent was first saturated with sulfur contaminants from a gasoline feed containing approximately 40 wppm sulfur. The sulfur-saturated adsorbent was then regenerated in flowing nitrogen heated from ambient temperature to 325° C. at 60° C./hr, then held at 325° C. for 2 hours. The nitrogen pressure during nitrogen regeneration was maintained at 2 psig while the nitrogen flow rate varied between 2 to 6 scf/hr (standard cubic feet per hour). The total sulfur in the liquid products from nitrogen regeneration was determined using Horiba x-ray analysis.

After the nitrogen regeneration step, a gasoline feed containing approximately 40 wppm total sulfur was pumped through a bed of 4 Å molecular sieve (61 grams) to remove water, and then pumped through the adsorbent-containing column. Earlier tests showed that the 4 Å molecular sieve bed does not remove sulfur contaminants from the feed. During the adsorption cycle, the gasoline feed rate was set at 12.5 cc/min to maintain a liquid hourly space velocity (LHSV) of 2 hr−1 (v/v/hr). The adsorbent bed was maintained at ambient conditions. An on-line sulfur analyzer was used to ascertain the sulfur breakthrough curve. The sulfur breakthrough curve for Example 1 is shown in the sole FIGURE hereof ($N_2$ regeneration).

EXAMPLE 2

A stainless steel column, 1.1" ID containing two feet, 370 cc of 1/20" extrudates of the adsorbent used in Example 1 above was first saturated with sulfur contaminants from a gasoline feed containing about 40 wppm sulfur. The sulfur-saturated adsorbent was then regenerated in flowing hydrogen heated from ambient temperature to 325° C. at a rate of 60° C./hr, then held at 325° C. for 2 hours. The hydrogen pressure during regeneration was maintained at 100 psig while the hydrogen flow rate varied between 2 to 6 scf/hr. The total sulfur in the liquid products from hydrogen regeneration was determined using Horiba x-ray analysis.

After hydrogen regeneration, a gasoline feed containing approximately 40 wppm total sulfur was pumped through a bed of 4 Å molecular sieve (61 grams) to remove water, and then pumped through the adsorbent column. Earlier tests showed that the 4 Å molecular sieve bed does not remove any sulfur contaminants in the feed. During the adsorption cycle, the gasoline feed rate was set at 12.5 cc/min to maintain a liquid hourly space velocity of 2 $hr^{-1}$ (v/v/hr). The adsorbent bed was maintained at ambient conditions. An on-line sulfur analyzer was used to ascertain the sulfur breakthrough curve. The sulfur breakthrough curve for this Example is shown in the sole FIGURE hereof ($H_2$ regeneration).

The Table below shows that the sulfur level of the hydrogen-regenerated product is significantly lower than that obtained for the nitrogen regenerated product. The hydrogen-regenerated product also contains a higher concentration of octane aromatics. This Table further shows that the sulfur adsorption capacity, after $H_2$ regeneration at 100 psig, is significantly higher than for $N_2$ regeneration. Sulfur capacity is measured as grams of sulfur per kilogram adsorbent (g S/kg ads).

TABLE

Comparison of $N_2$ and $H_2$ Regeneration Performance

| | Regeneration Agent | |
|---|---|---|
| | $N_2$ | $H_2$ |
| Product Sulfur, wppm | 581 | 379 |
| Sulfur Capacity (g S/kg ads) | 0.71 | 2.05 |

The invention claimed is:

1. A process for removing organic sulfur and elemental sulfur moieties from a sulfur moiety-containing hydrocarbon stream, which process comprises:

contacting the sulfur moiety-containing hydrocarbon stream in the substantial absence of added hydrogen with an adsorbent material comprised of at least one Group VIII metal and at least one Group VI metal selected from the group consisting of Mo and W on a suitable refractory support material until the adsorbent material becomes substantially saturated;

regenerating the substantially saturated adsorbent material at hydrodesulfurization conditions in the presence of a flow of hydrogen-containing gas at effective pressures of about 60 to 500 psig and temperatures of about 200° C. to about 500° C. to result in the desulfurization, by conversion to hydrogen sulfide, of at least a portion of the adsorbed sulfur moieties from the adsorbent material.

2. The process of claim 1 wherein the hydrodesulfurization conditions include a pressure of from about 0 to about 2000 psig, and a temperature from about 100° C. to about 600° C.

3. The process of claim 1 wherein the hydrogen-containing gas is selected from substantially pure hydrogen and a mixture of hydrogen and hydrogen sulfide.

4. The process of claim 3 wherein the hydrogen-containing gas is substantially pure hydrogen.

5. The process of claim 1 wherein said sulfur moieties are organically bound sulfur compounds selected from the group consisting of aliphatic mercaptans, naphthenic mercaptans, aromatic mercaptans, sulfides, di-sulfides, polysulfides, thiophenes, their higher homologs, and their higher analogs.

6. The process of claim 1 wherein said adsorbent is a hydrotreating catalyst comprised of at least one Group VIII metal and at least one Group VI metal selected from the group consisting of Mo and W on an inorganic metal oxide support material.

7. The process of claim 6 wherein the Group VIII metal is selected from Co, Ni, and Fe.

8. The process of claim 6 wherein said hydrotreating catalyst further comprises a metal selected from the group consisting of Group IA metals, Group IIA metals, and Group IB metals.

9. The process of claim 1 wherein said sulfur moiety-containing hydrocarbon stream boils in the range of about 10° C. to about 600° C.

10. The process according to claim 9 wherein said sulfur moiety-containing hydrocarbon stream is a distillate stream boiling in the range of about 150° C. to about 600° C.

11. The process of claim 9 wherein said sulfur moiety-containing hydrocarbon stream is a naphtha stream boiling in the range of about 10° C. to about 230° C.

12. The process of claim 1 wherein the adsorbent is contained on a fixed bed arrangement.

13. The process of claim 1 wherein the hydrogen-containing gas is passed through said adsorbent on a once-through basis.

14. The process of claim 1 wherein the hydrogen-containing gas is recycled to the adsorbent bed.

15. The process of claim 9 wherein the desulfurized hydrocarbon stream product is condensed.

* * * * *